United States Patent [19]

Tomosky et al.

[11] Patent Number: 4,844,452

[45] Date of Patent: Jul. 4, 1989

[54] SELF-SUPPORTING INFANT JUMPER DEVICE

[76] Inventors: Thomas K. Tomosky; Nancy Tomosky, both of 951 Greenbriar Dr., Blue Bell, Pa. 19422

[21] Appl. No.: 182,023

[22] Filed: Apr. 15, 1988

[51] Int. Cl.[4] ..... A63G 9/00

[52] U.S. Cl. ..... 272/85; 272/92; 297/274; 297/275

[58] Field of Search ..... 272/85, 92; 297/274, 297/275, 5, 273, 278; 5/127

[56] References Cited

U.S. PATENT DOCUMENTS

| | | | |
|---|---|---|---|
| 16,150 | 12/1856 | Robbins | 297/5 |
| D. 55,384 | 6/1920 | Kingsbury et al. | 5/127 X |
| 58,510 | 10/1866 | Thompson | 297/274 |
| 159,639 | 2/1875 | Burgess | 297/273 X |
| 439,648 | 11/1890 | Franklin | 272/92 |
| 459,670 | 9/1891 | Barnhart | 297/273 |
| 692,505 | 2/1902 | Crutchfield | 297/274 |
| 1,072,959 | 9/1913 | Kincannon | 297/275 X |
| 1,297,800 | 3/1919 | Cranford | 297/274 |
| 2,448,325 | 8/1948 | Poorman, Jr. | 272/85 X |
| 3,721,437 | 3/1973 | Skaricic | 297/275 X |
| 3,722,883 | 3/1973 | O'Dowd | 272/85 |

FOREIGN PATENT DOCUMENTS

| | | | |
|---|---|---|---|
| 498371 | 1/1951 | Belgium | 272/85 |
| 555841 | 7/1923 | France | 297/275 |
| 726666 | 6/1932 | France | 297/275 |

*Primary Examiner*—David A. Scherbel
*Assistant Examiner*—Richard E. Chilcot, Jr.
*Attorney, Agent, or Firm*—John J. Selko

[57] ABSTRACT

A collapsible, free-standing, self-supporting infant jumper seat having a horizontal traverse rod detachably connected to a bottom frame. A seat is elastically and rotatably fastened to the rod, and moves therealong. Casters are connected to the bottom frame.

9 Claims, 3 Drawing Sheets

SELF-SUPPORTING INFANT JUMPER DEVICE

BACKGROUND OF THE INVENTION

This invention relates to infant jumper devices, and more particularly to jumper devices for infants not yet fully capable of standing and walking without assistance.

It is well known to provide infant jumper devices which elastically support an infant in a seat to permit the infant's feet to contact the floor or other surface. Such devices are adapted to permit the infant to bounce up and down and to cause the seat to rotate and to move along a horizontally extending traverse rod, providing exercise and limited mobility to the infant.

Such devices are exemplified by the following U.S. Pat. Nos. 58,510 to J. P. Thompson; 692,505 to J. H. Crutchfield; and 1,297,800 to H. L Cranford.

The patent to Thompson shows a jumper supported from, and movable along, a horizontal rail suspended from a ceiling. The patent to Crutchfield shows a jumper device supported from, and movable along, a swingable horizontal arm. The arm is affixed to the side of a house. The patent to Cranford shows a jumper supported from, and movable along, a horizontal arm which is pivotable about a central support member. The central support member is affixed to the ceiling and floor of a room.

A limiting factor of all such prior art devices is that the devices are not free standing and self-supporting. They must be affixed to, or supported by a permanent structure such as a wall of ceiling. Accordingly, such prior art devices are not portable or capable of being readily moved from one location to another. Such portability is important because it permits the infant remain in the company of a parent at various locations, while the parent performs household tasks. Furthermore, such prior art devices are not capable of being collapsed, or disassembled, into smaller sections of assembly and use at locations completely away from permanent support structures.

There is need, therefore, for an infant jumper which is free standing and self supporting, providing mobility to the device. There is also a need for such a device which is collapsible into smaller sections, making it readily transportable.

The device of this invention satisfies the needs of the prior art.

The device of this invention satisfies the needs of the prior art.

SUMMARY OF THE INVENTION

This invention provides a collapsible, self-supporting infant jumper having a traversing rod spaced above a bottom frame member, and side member means for detachably connecting the traversing rod and bottom frame member. Infant support means elastically and rotatably suspends from the traverse rod and moves therealong. Casters for additional mobility of the device are connected to the bottom frame member.

DESCRIPTION OF PREFERRED EMBODIMENT AND BEST MODE

Figure 1:
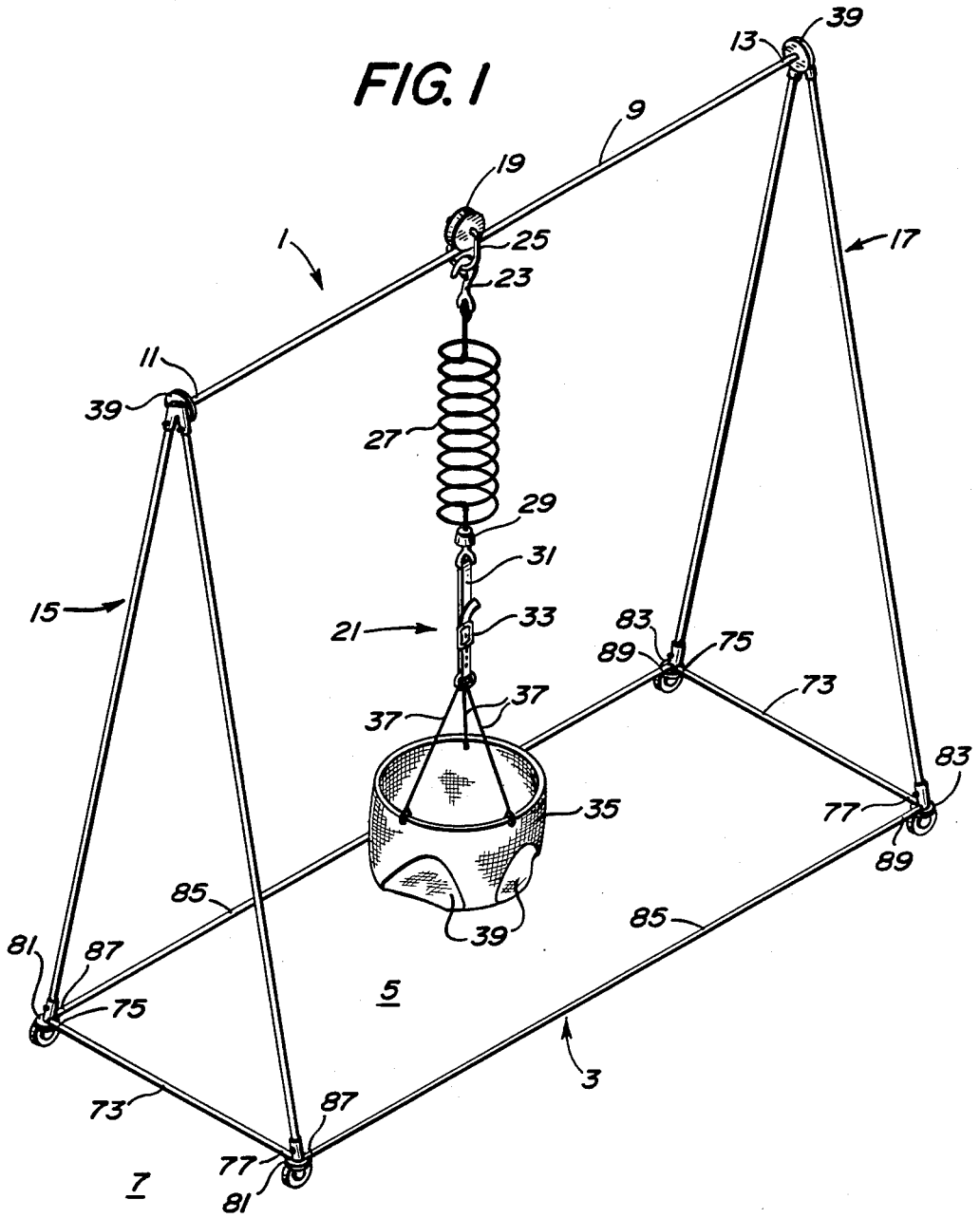
FIG. 1 is an isometric view of the invention.
Figure 2:
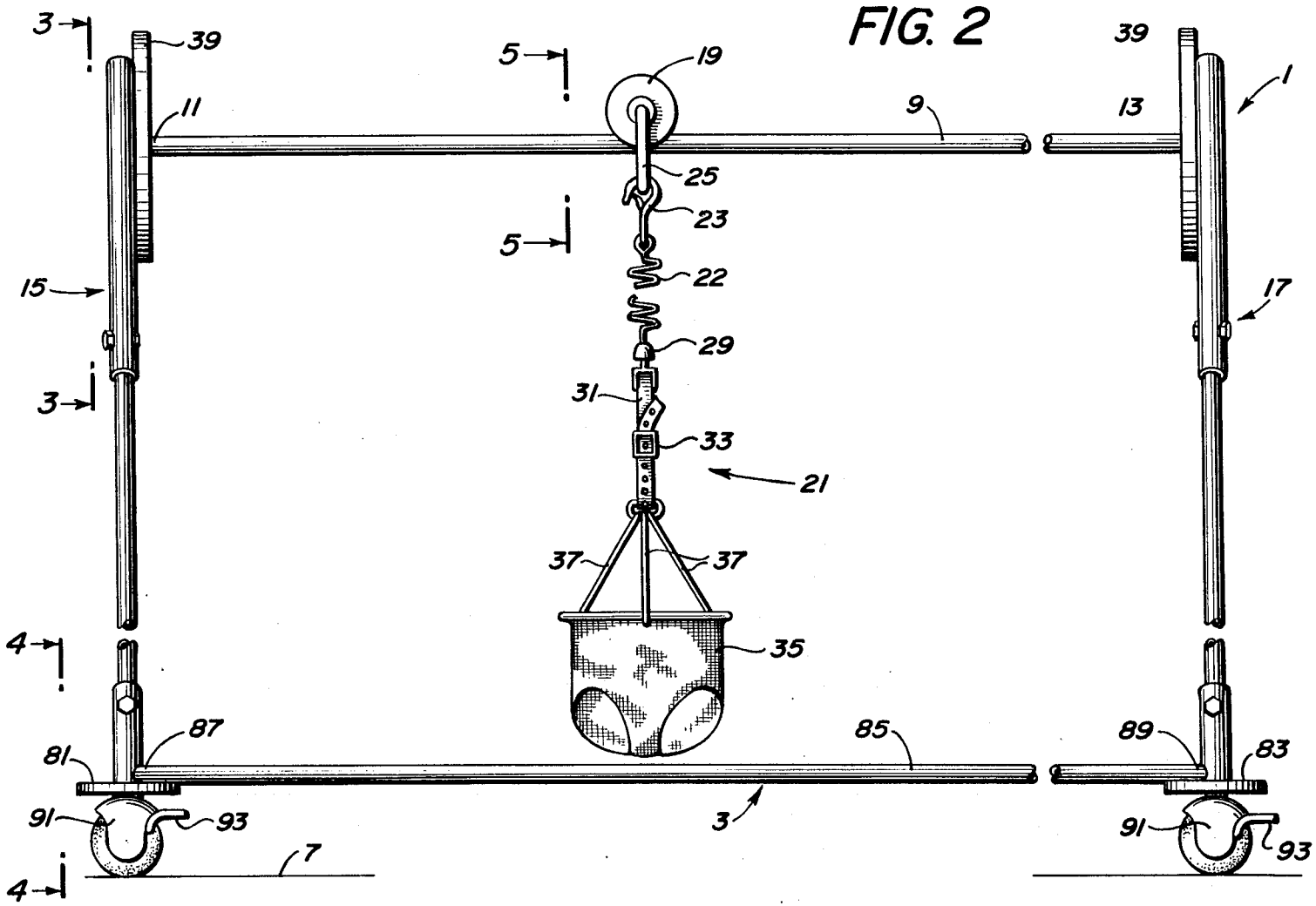
FIG. 2 is a front elevation of the invention.
Figure 5:
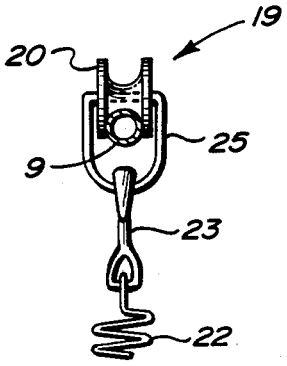
FIG. 5 is a section taken along lines 5—5 of FIG. 2.

Referring to FIG. 1, FIG. 2 and FIG. 5, the jumper of this invention, shown generally as 1, includes a hollow tubular bottom frame member 5 defining a substantially horizontal planar area 5 above a floor or other surface 7.

Spaced above bottom frame member 3 is a hollow tubular top traversing rod 9, extending substantially horizontally above bottom member 3. Rod 9 has a first and second end 11 and 13 respectively. First end 11 is detachably connected to bottom frame member 3 by a first hollow tubular side member means 15, as will be further described hereinafter.

Second end 13 is detachably connected to bottom frame member 3 by a second hollow tubular side member means 17, as will be further described hereinafter.

First and second side member means 15 and 17 are similarly constructed and attached to bottom frame member 3. Therefore, a description of first side member means 15 and its attachment will be the same as for second side member means 17 and will not be repeated.

Pulley means 19 is mounted with wheel 20 on rod 9 for movement therealong. Infant jumper means 21 is elastically and rotatably suspended from said pulley means 19 a distance above the floor 7 to permit an infant (not shown) to touch the floor with both feet when the infant is carried in the jumper means.

Jumper means 21 includes a clip 23 detachably connected to yoke 25 of pulley means 19, an elastic spring 27 connected to clip 23, and a swivel 29 connected to spring 27. Swivel 29 is of conventional design with a loop through which is fastened an adjustment belt 31 having a conventional belt buckle 33. Belt buckle 33 permits belt 31 to be lengthened or shortened to vertically raise or lower infant seat 35. Seat 35 is suspended from belt 31 by a plurality (preferably three) support straps 37. Seat 35 holds and supports an infant's bottom and lower back, but permits the infant's legs to extend outwardly and downwardly through apertures 39 to touch the floor 7.

It should be understood that pulley means 19 and infant support means 21 combine to permit the infant to bounce up and down, to permit the infant support means 21 to rotate through 360 degrees and to move horizontally back and forth along rod 9. The design of pulley means 19 and infant support means 21 is conventional, and other prior art designs of such elements would be equivalent, so long as they provide the same functions.

Figure 3:
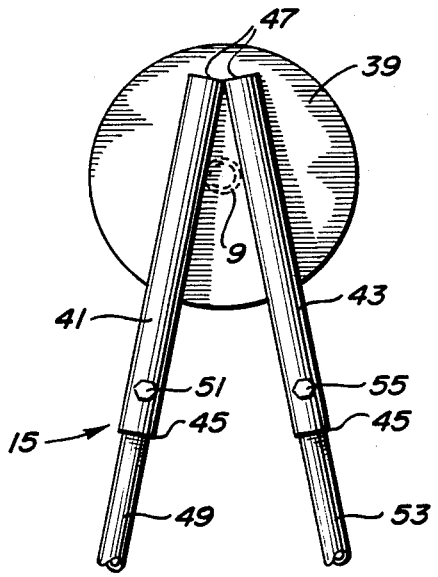
FIG. 3 is a view along lines 3—3 of FIG. 2.
Figure 4:
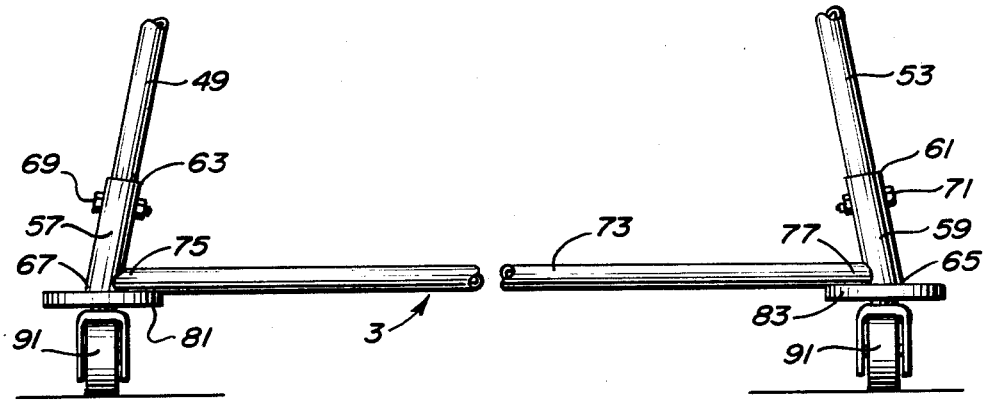
FIG. 4 is a view along lines 4—4 of FIG. 2.

Referring to FIG. 3 and FIG. 4, the preferred means for detachably connecting first side member 15 means to end 11 of rod and bottom frame member 3 is shown. Mounting plate 39 extends vertically downward and is permanently fastened, at one surface thereof, as by welding, to end 11 of rod 9. Mounting plate 39 is in a plane which is perpendicular and transverse to rod 9. A first and second hollow tubular sleeve 41 and 43, respectively, are permanently fastened, as by welding, to plate 39 at a surface thereof opposite to the surface to which end 11 is fastened. Sleeves 41 and 43 each have a lower end 45 angularly disposed away from each other in a downward direction. Conversely, upper ends 47 of sleeves 41 and 43, respectively, are angled toward each other in an upward direction. Although it is preferable to weld mounting plate 39 to rod 9, it would be equivalent to detachably connect mounting plate 39 and rod 9.

A first elongated hollow tubular leg 49 is slidably fitted into first sleeve 41, and detachably fastened therein by a nut and bolt fastener 51, which extends through sleeve 41 and leg 49 via overlapping apertures therein.

A second elongated hollow tubular leg 53 is slidably fitted into second sleeve 43, and detachably fastened therein by a nut and bolt fastener 55, which extends through sleeve 43 and leg 53 via overlapping apertures therein.

As shown in FIG. 4, a third and fourth hollow tubular sleeve, 57 and 59 respectively, are spaced apart and permanently fastened, as by welding, to bottom frame member 3. Sleeves 57 and 59 have upper ends 61 and 63 angularly disposed toward each other in an upward direction, and lower ends 65 and 67 angularly disposed away from each other in a downward direction. Sleeves 57 and 59 extend upwardly toward sleeves 41 and 43 respectively, thereabove. Sleeves 57 and 59 are generally in the same vertical plane as sleeves 41 and 43, which plane passes through end 11 of rod 9 at a perpendicular to the length of rod 9. However, it would be equivalent if the plane of sleeves 41, 43, 57 and 59 are not exactly vertical.

First leg 49 is slidably fitted into third sleeve 57, and detachably fastened therein by a nut and bolt fastener 69, which extends through sleeve 57 and leg 49 via overlapping apertures therein.

Second leg 53 is slidably fitted into fourth sleeve 59, and detachably fastened therein by a nut and bolt fastener 71, which extends through sleeve 59 and leg 53 via overlapping apertures therein.

Bottom frame member 3 includes a first pair of spaced apart, parallel, substantially horizontal hollow tubular braces 73, having a first and second end 75 and 77 permanently fastened, as by welding, to a horizontal mounting plate 81 and 83, respectively. A second pair of spaced apart, parallel, substantially horizontal hollow tubular braces 85 (FIG. 2), having a first and second end 87 and 89, permanently fastened, as by welding, to mounting plate 81 and 83 respectively. Braces 85 are in the same horizontal plane as braces 73, and are generally at right angle thereto. Thus, it should be understood that first and second pair of braces 73 and 85 preferably form a generally rectangular shape, the braces connecting to a mounting plate at the corners thereof. However, it would be equivalent to have the bottom frame member form a different shape, such as circular or oval.

Fastened to each corner of bottom frame member 3, at the mounting plate 81 and 83, is a conventional caster assembly 91. The casters are connected to bottom member 3 by by conventional and well known means, such as nuts and bolts (not shown). An optional feature is to provide the casters with a brake device of conventional design shown generally as 93 for locking the jumper in position. Any well known brake design will suffice.

It should be understood that the description for the second side member means 17, together with its attachment to rod 9 and bottom frame member 3, will be the same as that set forth hereinabove for first side member means 15.

Furthermore, while it is preferred to connect sleeves 41, 43, 57 and 59 to mounting plates 39, 81 and 83, it would be equivalent to provide a structure which eliminated the use of such mounting plates. Such a structure would have sleeves 41 and 43 directly fastened, as by welding, to rod 9, and sleeves 57 and 59 directly fastened, as by welding, to braces 73 and 85.

I prefer to make sleeves 41, 43, 57, and 59 from 9/16 inch inside diameter steel tubing. Legs 49 and 53, as well as braces 73 and 85, should be ½ inch outside diameter steel tubing. However, rigid plastic or other conventional materials will also suffice, provided they provide sufficient strength to the structure. Also, the materials can be solid, as opposed to the preferable hollow tubular members.

I claim:

1. A collapsible, self-supporting infant jumper comprising:

a. a bottom frame member defining a substantially horizontal planar area above a floor;

b. a top traversing rod spaced substantially horizontally above said bottom frame member, said rod having a first and second end, said first and second end each connected to a mounting plate extending downwardly in a plane which is perpendicular and transverse to said rod;

c. first side member means for detachably connecting said mounting plate of said first end of said traversing rod to said bottom frame member;

d. second side member means for detachably connecting said mounting plate of said second end of said traversing rod to said bottom frame member;

e. pulley means mounted on said traversing rod for movement therealong; and f. infant support means for elastically and rotatably suspending an infant from said pulley means a distance above the floor to permit said infant to touch said floor with its feet whereby said pulley means is caused to move along said traverse rod.

2. The invention of claim 1 in which said first and second side member means each includes:

a. a first and second hollow tubular sleeve fastened to said mounting plate, said sleeves being angularly disposed away from each other in a downward direction;

b. a third and fourth hollow tubular sleeve spaced apart and fastened to said bottom frame member, said sleeves being angularly disposed toward each other in an upward direction and extending toward said first and second sleeves thereabove;

c. a first elongated hollow tubular leg extending between said first and third sleeves;

d. a second elongated hollow tubular leg extending between said second and fourth sleeves; and e. means for detachably connecting said first and second hollow tubular legs to said sleeves.

3. The invention of claim 2 in which said bottom frame member defines a rectangular area, and includes:

a. a first pair of spaced apart, parallel, substantially horizontal, hollow tubular braces, each brace having a first and second end fastened to a mounting plate; and b. a second pair of spaced apart, parallel, substantially horizontal, hollow tubular braces disposed at right angles to said first pair of braces, each said brace having a first and second end fastened to said mounting plates.

4. The invention of claim 3 including:

a. a plurality of casters fastened to said bottom frame member to provide mobility to said jumper.

5. The invention of claim 4 including means on said casters for braking.

6. A collapsible, self-supporting infant jumper comprising:

a. a bottom frame member defining a substantially horizontal planar area above a floor;

b. a top traversing rod spaced substantially horizontally above said bottom frame member, said rod having a first and second end;

c. first side member means for detachably connecting said first end of said traversing rod to said bottom frame member;

d. second side member means for detachably connecting said second end of said traversing rod to said bottom frame member;

e. said first and second side member means each including:

i. a mounting plate fastened to one end of said traversing rod;

ii. a first and second hollow tubular sleeve fastened to said mounting plate, said sleeves being angularly disposed away from each other in a downward direction;

iii. a third and fourth hollow tubular sleeve spaced apart and fastened to said bottom frame member, said sleeves being angularly disposed toward each other in an upward direction and extending toward said first and second sleeves thereabove;

iv. a first elongated hollow tubular leg extending between said first and third sleeves;

v. a second elongated hollow tubular leg extending between said second and fourth sleeves; and vi. means for detachably connecting said first and second hollow tubular legs to said sleeves;

f. pulley means mounted on said traversing rod for movement therealong; and g. infant support means for elastically and rotatably suspending an infant from said pulley means a distance above the floor to permit said infant to touch said floor with its feet whereby said pulley means is caused to move along said traverse rod.

7. The invention of claim 6 in which said bottom frame member defines a rectangular area, and includes:

a. a first pair of spaced apart, parallel, substantially horizontal, hollow tubular braces, each brace having a first and second end fastened to a mounting plate; and b. a second pair of spaced apart, parallel, substantially horizontal, hollow tubular braces disposed at right angles to said first pair of braces, each said brace having a first and second end fastened to said mounting plates.

8. The invention of claim 7 including:

a. a plurality of casters fastened to said bottom frame member to provide mobility to said entire jumper.

9. The invention of claim 8 including means on said casters for braking.

* * * * *